US008672780B2

(12) United States Patent
Fournier

(10) Patent No.: US 8,672,780 B2
(45) Date of Patent: Mar. 18, 2014

(54) BATTING TEE WITH PIVOT CONNECTION

(76) Inventor: Alain Fournier, Val-d'Or (CA)

( * ) Notice: Subject to any disclaimer, the term of this patent is extended or adjusted under 35 U.S.C. 154(b) by 275 days.

(21) Appl. No.: 13/154,633

(22) Filed: Jun. 7, 2011

(65) Prior Publication Data

US 2012/0040780 A1 Feb. 16, 2012

Related U.S. Application Data

(60) Provisional application No. 61/373,516, filed on Aug. 13, 2010.

(51) Int. Cl.
*A63B 69/00* (2006.01)

(52) U.S. Cl.
USPC ..... 473/417

(58) Field of Classification Search
USPC ..... 473/417, 422, 423, 431, 451; D21/717, D21/780
See application file for complete search history.

(56) References Cited

U.S. PATENT DOCUMENTS

| | | | | | |
|---|---|---|---|---|---|
| 2,616,692 | A * | 11/1952 | Bird | 473/417 |
| 2,862,712 | A * | 12/1958 | Delia et al. | 473/423 |
| 3,874,662 | A * | 4/1975 | Harrington | 473/417 |
| 4,364,563 | A * | 12/1982 | Stafford | 473/417 |
| 4,681,318 | A * | 7/1987 | Lay | 473/423 |
| 4,993,708 | A * | 2/1991 | Prossor et al. | 473/417 |
| 5,386,988 | A * | 2/1995 | Sung et al. | 473/423 |
| 5,393,050 | A * | 2/1995 | Lloyd | 473/429 |
| 6,398,671 | B1 * | 6/2002 | Rios | 473/417 |
| 6,551,204 | B1 | 4/2003 | Di Re | |
| 6,616,554 | B2 * | 9/2003 | Liao | 473/417 |
| 6,893,363 | B1 | 5/2005 | Chen et al. | |
| 7,204,769 | B2 * | 4/2007 | Bandimere et al. | 473/417 |
| 7,458,907 | B2 * | 12/2008 | Wang | 473/417 |
| 7,704,168 | B1 | 4/2010 | Hochberg | |
| 7,775,912 | B2 * | 8/2010 | Aguirre | 473/423 |
| D638,079 | S * | 5/2011 | Cheng | D21/717 |
| 8,109,844 | B1 * | 2/2012 | Quinn | 473/417 |
| 8,257,202 | B1 * | 9/2012 | Stanek | 473/417 |
| 2005/0288120 | A1 * | 12/2005 | Brescia | 473/266 |
| 2006/0035729 | A1 * | 2/2006 | Wang | 473/417 |
| 2009/0029803 | A1 * | 1/2009 | Lincoln | 473/417 |

* cited by examiner

*Primary Examiner* — Mitra Aryanpour
(74) *Attorney, Agent, or Firm* — Norton Rose Fulbright Canada

(57) ABSTRACT

A batting tee with two spaced apart support arms extending upwardly from the base plate, two spaced apart retaining members extending between the support arms and connected thereto or to the base plate, and a pivot extending between the support arms at a location intermediate that of the two retaining members. The shaft's bottom end is received between the two support arms and between the two retaining members and is connected adjacent the bottom end to the two support arms by the pivot extending therethrough. The pivot defining a single pivot axis about which the shaft is pivotable relative to the base plate between a first position in contact with only one of the retaining members and a second position in contact with only the other of the retaining members, for impact energy absorption.

21 Claims, 10 Drawing Sheets

BATTING TEE WITH PIVOT CONNECTION

CROSS-REFERENCE TO RELATED APPLICATIONS

This application claims priority on U.S. provisional application No. 61/373,516 filed Aug. 13, 2010, which is incorporated by reference herein in its entirety.

FIELD OF THE INVENTION

The present invention relates to ball hitting practice devices, particularly to such devices for use in softball or baseball.

BACKGROUND ART

Baseball and softball players regularly use batting tees to support the ball during batting practice. However, known batting tees are generally unstable, in that they fall down relatively easily when the player hits the ball too low and touches the tee with the bat. This results in loss of time for the player every time the tee needs to be put back into the upright position, thus taking away from a player's limited practice time. In addition, unstable tees generally have a relatively short useful life, as they are subject to being damaged every time they fall down.

In addition, known batting tees typically include a ball supports which hides a significant portion of the ball being supported, thus increasing the chances of the batting tee being hit when a player attempts to hit the ball.

A number of designs have been proposed to improve the stability of batting tees. However, such designs are generally complex and/or make the tee more bulky to transport. It has been known to provide a batting tee in two or more pieces that can be separated for transport; however the separate pieces generally increase the risk of loosing one or more the tee components, thus rendering it unusable.

Accordingly, improvements are sought.

SUMMARY

It is therefore an aim of the present invention to provide an improved batting tee.

Therefore, in accordance with the present invention, there is provided a batting tee comprising a base plate, two spaced apart support arms extending upwardly from the base plate, two spaced apart retaining members extending between the support arms and connected thereto or to the base plate, a pivot extending between the support arms at a location intermediate that of the two retaining members, and a shaft having a top end configured to support a ball, and an opposed bottom end received between the two support arms and between the two retaining members, the shaft being connected adjacent the bottom end to the two support arms by the pivot extending therethrough with the bottom end being spaced apart from the base plate and being located below the retaining members, the pivot defining a single pivot axis about which the shaft is pivotable relative to the base plate between a first position in contact with only one of the retaining members and a second position in contact with only the other of the retaining members, the shaft in the first and second positions being sufficiently close to a vertical position for retaining a ball on the top end.

Also in accordance with the present invention, there is provided a batting tee comprising a base plate, two spaced apart support arms extending upwardly from the base plate, the support arms having aligned pivot holes defined therethrough, two spaced apart retaining members extending between the support arms and connected thereto or to the base plate and each located on a respective side of the pivot holes, a pivot removably retainable through the aligned pivot holes, and a shaft having a top end shaped to support a ball and alternately configurable in a use configuration and in a storage configuration, wherein in the use configuration, a bottom end of the shaft is received between the support arms and between the retaining members, the shaft being pivotally connected to the support arms adjacent the bottom end by the pivot extending therethrough and through the pivot holes with the bottom end spaced apart from the base plate, the pivot defining a single pivot axis about which the shaft is pivotable relative to the base plate along a path limited by contact of the shaft with each of the retaining members while remaining sufficiently close to a vertical position to retain the ball on the top end, and wherein in the storage configuration, the shaft is positioned between the support plates with a longitudinal axis of the shaft at least approximately parallel to the base plate, the shaft being retained to the base plate by the removable pivot extending through aligned storage holes defined through the shaft and connected to the support plates, the retaining members preventing or substantially preventing rotation of the shaft about the pivot.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
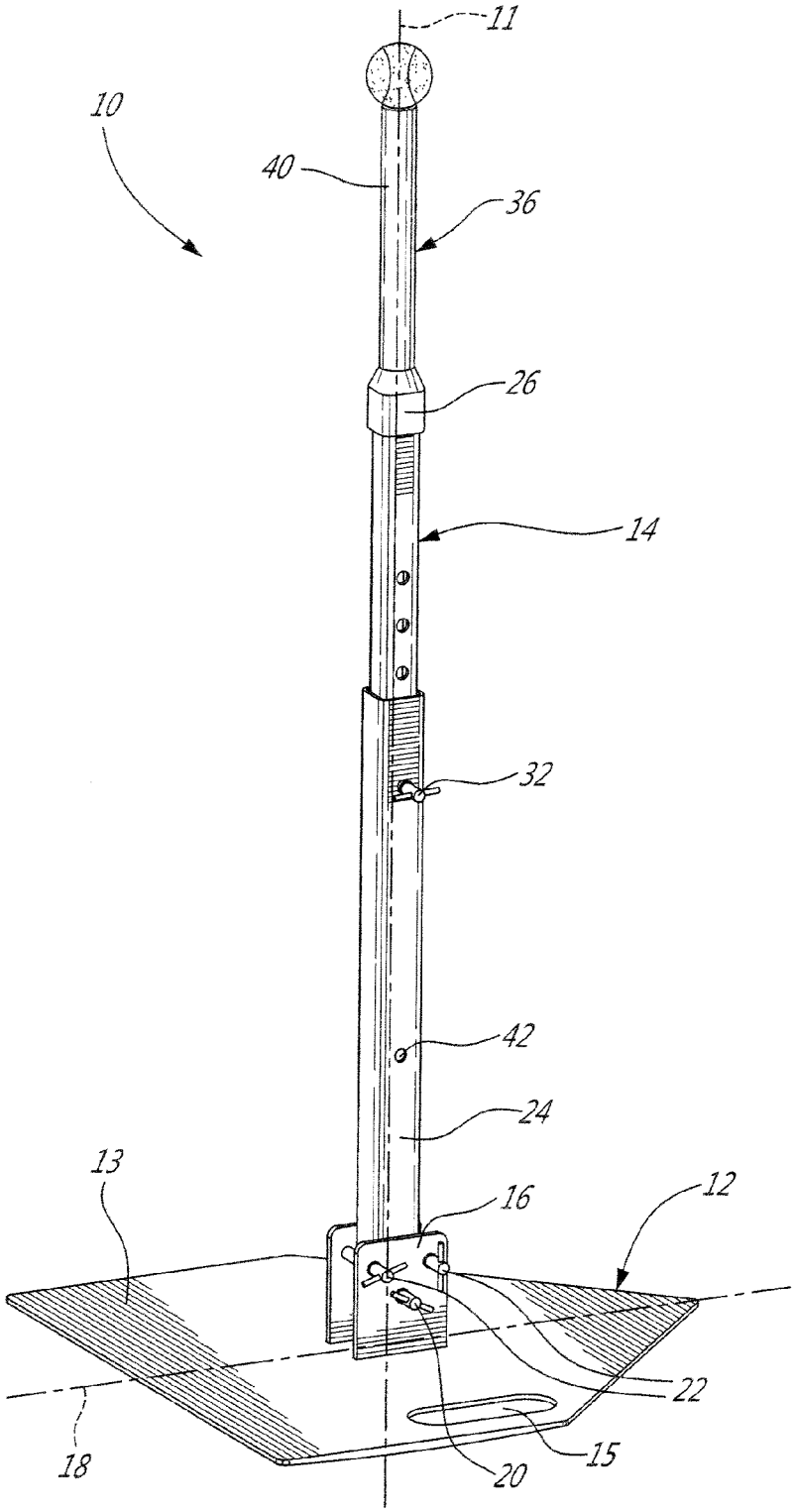
FIG. 1 is a schematic tridimensional view of a batting tee in accordance with a particular embodiment.
Figure 2:
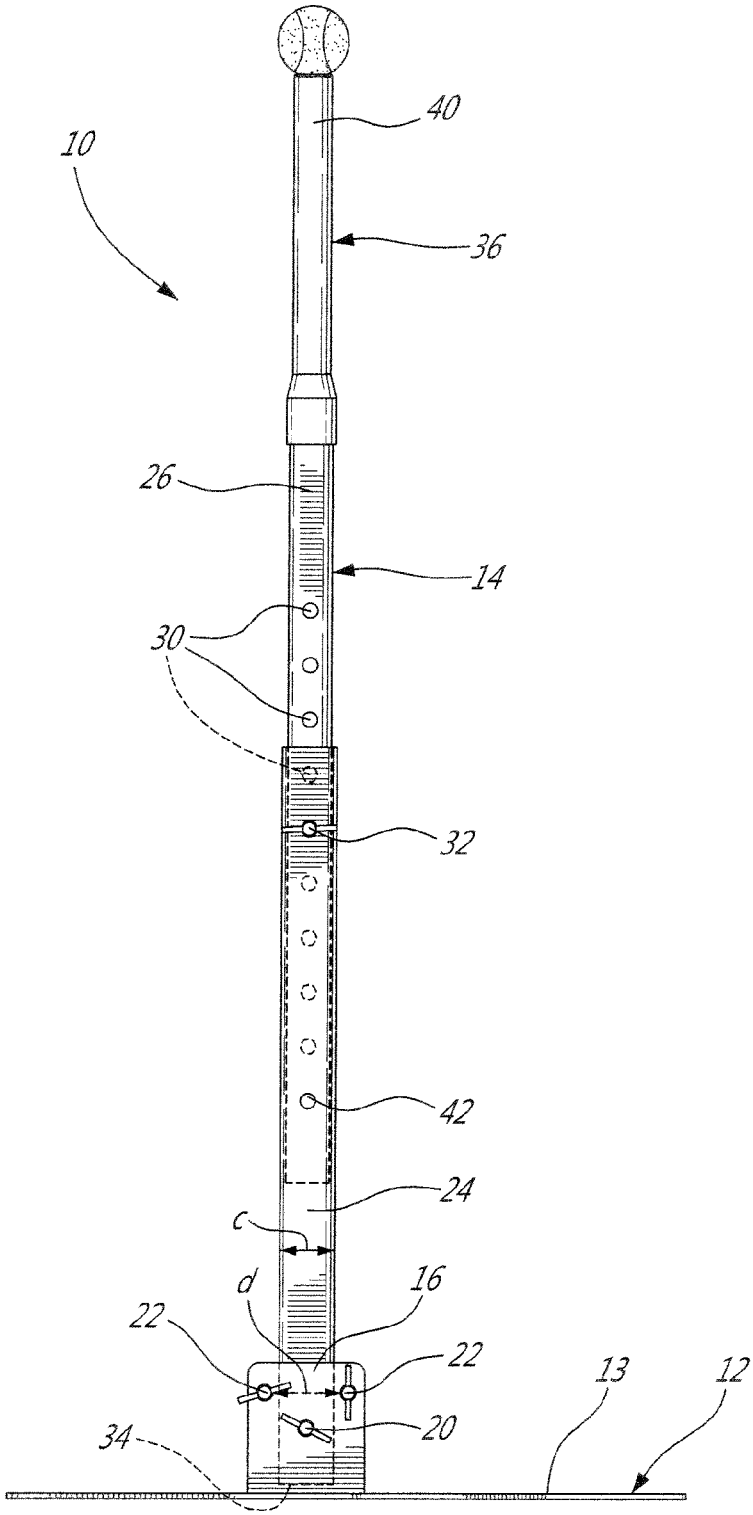
FIG. 2 is a schematic side view of the tee of FIG. 1.
Figure 3:
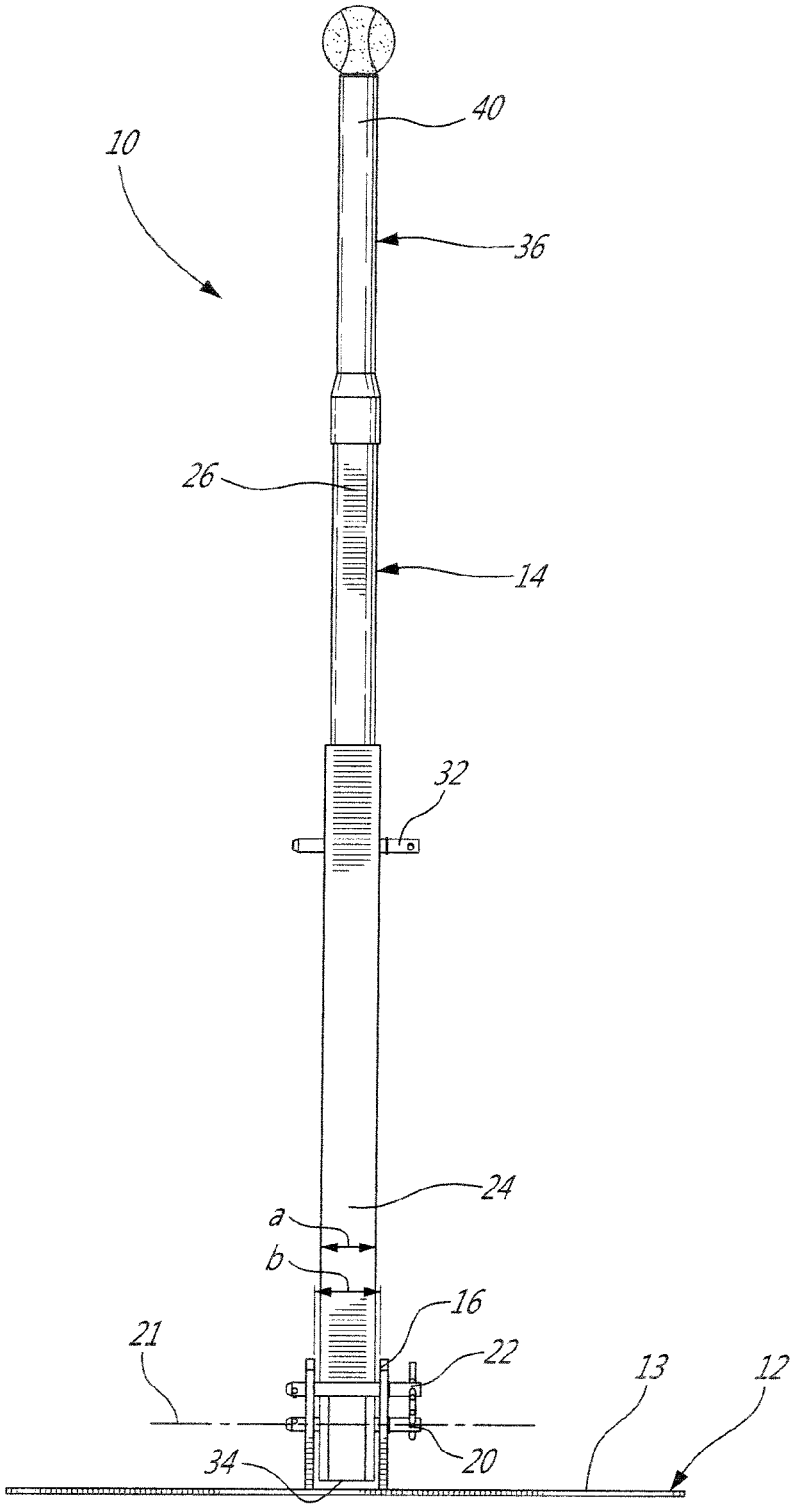
FIG. 3 is a front view of the tee of FIG. 1.

Referring to FIGS. 1-3, a batting tee 10 is shown, generally comprising a base 12 and a shaft 14 connected thereto.

The base 12 includes a base plate 13 which in the embodiment shown has the pentagonal shape typical of a baseball or softball base plate, although any other adequate alternate shape is also possible. The base plate 13 optionally has a handle hole 15 defined therein for carrying the tee in the storage configuration (further detailed below). The base 12 further includes two support arms 16 which extend upwardly from the base plate 13. The support arms 16 are spaced apart from and preferably parallel to one another. In the embodiment shown, the support arms 16 are defined by rectangular plates which are located on a respective side of and at a same distance from the axis of symmetry 18 of the base plate 13 (see FIG. 3). In a particular embodiment, the support arms 16 are made of portions of the base plate 13 which have been cut and folded upwards; in an alternate embodiment, the support arms 16 are separately manufactured and attached to the base plate 13.

The support arms 16 support a pivot 20 which extends therebetween in proximity of the base 12, and in a central position along the axis of symmetry 18. The support arms 16 also support two spaced apart and preferably parallel retaining members 22 each located on a respective side of the pivot 20.

In the embodiment shown, the pivot 20 and retaining members 22 are each defined by cylindrical members, such as a respective bolt extending through corresponding aligned holes in the support arms 16 and retained by a nut on each side. The retaining members 22 each located at a greater height than the pivot 20 with respect to the base plate 13 to allow the shaft to be received between the base plate and the retaining members in a storage and/or folded configuration, as will be further detailed below. For example, in a particular embodiment, the retaining members are located about 2 7/16 inches above the base plate 13 while the pivot is located about 1⅝ inch above the base plate 13; other dimensions are of course possible.

Other suitable elements for the pivot 20 and retaining members 22 include locking pins, screws engaged with threaded holes in the support arms 16, etc. Alternately, the pivot 20 and/or the retaining members 22 may be permanently connected to the support arms 16 or base plate 13, for example, the retaining members 22 may be in the form of plates connected, e.g. welded, to the support arms 16, or in the form of brackets having an inverted U-shape and connected, e.g. welded, to the base plate 13, on each side of the support arms 16. However, if it is desired to be able to place the batting tee 10 in the folded configuration which will be described further below, at least one of the retaining members 22 must be removably connected to the rest of the base 12. Similarly, if it is desired to be able to place the batting tee 10 in the storage configuration which will be described further below, at least the pivot 20 must be removably connected to the rest of the base 12. Removable ones of the retaining members 22 and pivot 20 may be attached to one the support arms 16, for example through a chain, to minimize the risk of loosing the retaining members 22 and/or pivot 20 when disengaged from the two support arms.

The shaft 14 is telescopic, and includes a bottom portion 24 which receives a top portion 26 therein. The bottom shaft portion 24 has a locating hole 28 defined therethrough perpendicularly to its longitudinal axis 11 (see FIG. 1), and the top shaft portion 26 has a series of vertically spaced apart locating holes 30 defined therethrough and configured for alignment with the locating hole 28 of the bottom shaft portion 24, to define an indexing mechanism for selectively adjusting the height of the top shaft portion 26 within the bottom shaft portion 24. Of course, a single locating hole can alternately be defined through the top shaft portion 26, with a plurality of locating holes defined through the bottom shaft portion 24. A removable pin 32 is inserted through the aligned locating holes 28, 30 to set the desired height of the shaft 14. In the embodiment shown, the removable pin 32 is attached to the bottom portion 24 of the shaft 14, for example through a chain, to minimize the risk of loosing the removable pin 32 when disengaged from the locating holes 28, 30.

The bottom shaft portion 24 defines the shaft's bottom end 34, which in the use configuration (shown in FIGS. 1-3) is received between the two support arms 16 and between the two retaining members 22. The bottom shaft portion 24 is pivotally connected to the base 12 adjacent the bottom and 34, through the pivot 20, such as to be pivotable about a single axis 21 (see FIG. 3). The hole defined through the shaft 14 to receive the pivot 20 is centered, such that the shaft 14 extends from the center of the base plate 13, thus maximizing the batting tee's stability. The hole defined through the shaft 14 is located such that the bottom end 34 is retained above the base plate 13 while leaving a gap therebetween, for example ¼ inch, to allow for the pivoting motion of the shaft 14.

In the embodiment shown, the shaft 14 has a square cross-section, although alternately the shaft 14 may have a circular cross-section. As shown in FIG. 3, the shaft 14 has a first dimension a defined along the pivot axis 21 which is smaller than the distance b between the two support arms 16, in order to allow the shaft 14 to pivot without interference from the support arms 16. Referring to FIG. 2, the shaft also has a second dimension c, defined perpendicularly to the first dimension a and to its longitudinal axis 11, which is smaller than the distance d between the two retaining members 22, such as to allow a limited pivoting motion of the shaft 14 when in the upright position, between a first position against one of the retaining members 22 and a second position against the other of the retaining members 22. The two retaining members 22 are however close enough to each other such that in the use configuration, the shaft 14 remains in an upright position suitable for supporting the ball throughout the range of possible positions between the two retaining members 22. For example, a difference of about 1/64 inch to 5/64 inches, and preferably about 1/32 inch to 1/16 inch between the dimensions c and d and between the dimensions a and b has been found to be satisfactory with the pivot and retaining member locations mentioned above; of course, other distances are also possible. In a particular embodiment, the retaining members allow a pivoting motion of approximately 5 degrees or less, and more preferably 2 degrees or less, about the pivot 20.

In a particular embodiment, the base plate 13 and shaft 14 are made of metal, for example steel. However, other adequate materials can alternately be used; alternate possible materials include aluminum, plastic, an adequate type of elastomeric material such as polyurethane, etc., or other materials having adequate shock resistance. The base plate 13 and shaft 14 are preferably made of a material that is UV resistant to prevent degradation of the batting tee after sun exposure.

Figure 10:
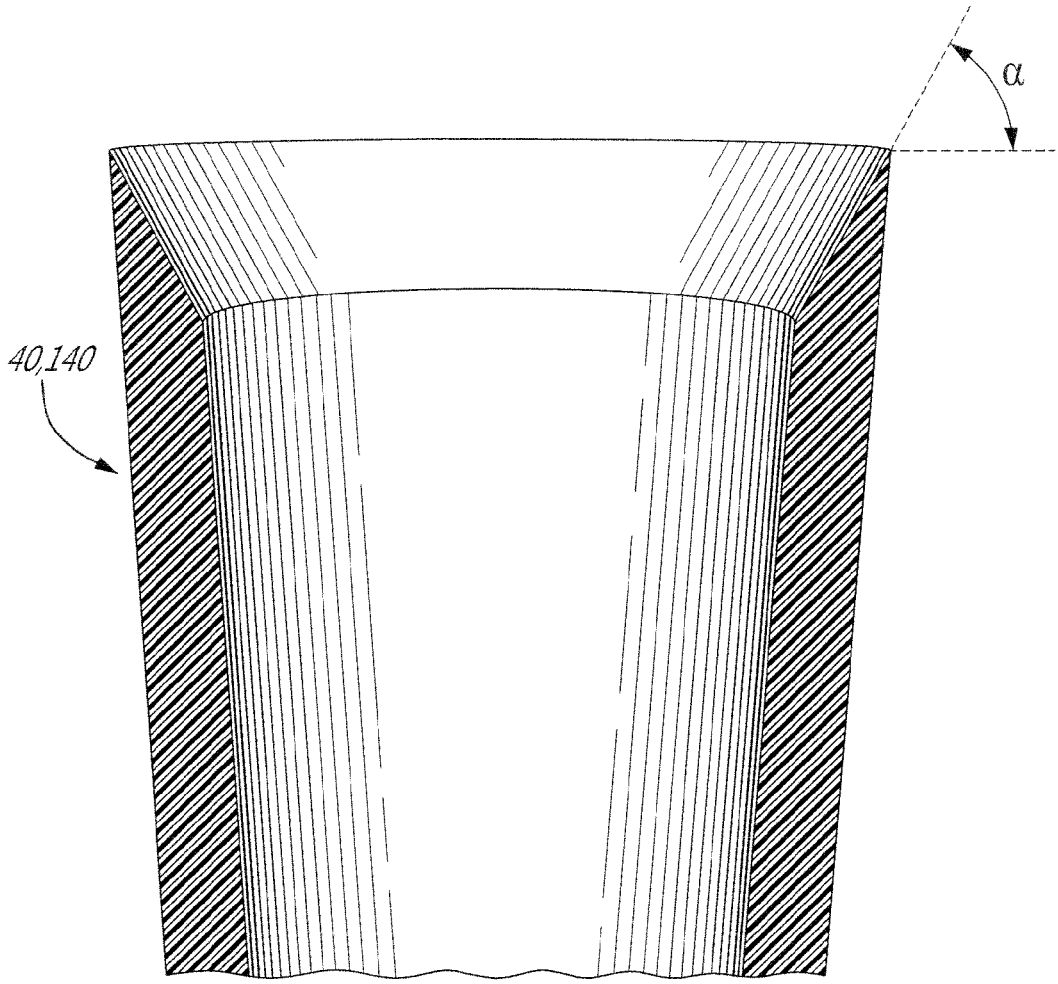
FIG. 10 is an enlarged view of a ball support which can be used with the tee of FIG. 1 or of FIG. 6.

The top portion 26 of the shaft 14 defines the shaft's top end 36, which is configured to support the ball. In the embodiment shown, the top portion 26 includes a cylindrical support 40 made of an elastomeric material, for example rubber or polyurethane, shaped to support a baseball on top thereof. The cylindrical support 40 may be permanently or removably connected to the remainder of the top shaft portion 26. In the embodiment shown, the top portion 26 is inserted in the cylindrical support 40 and frictionally retained therein, but other means of connection are also possible. Referring to FIG. 10, the ball end of the cylindrical support 40 has a frusto-conical inner surface which defines an enlarged inner end portion for supporting the ball. In a particular embodiment, this enlarged portion defines a maximum circular cross-section having a diameter of between 1 1/32 and 1½ inch, more preferably at most 1¼ inch, for a ball having a diameter of 3 inches. The frusto-conical inner surface extends at an angle $\alpha$ of approximately 45° to 75° from the horizontal, preferably 60° to 70° from the horizontal, more preferably 67.5° from the horizontal. The relatively small diameter of the support allows a significant portion of the ball to protrude above the support 40, thus reducing the likelihood of the player hitting the support 40 while trying to hit the ball.

Figure 4:
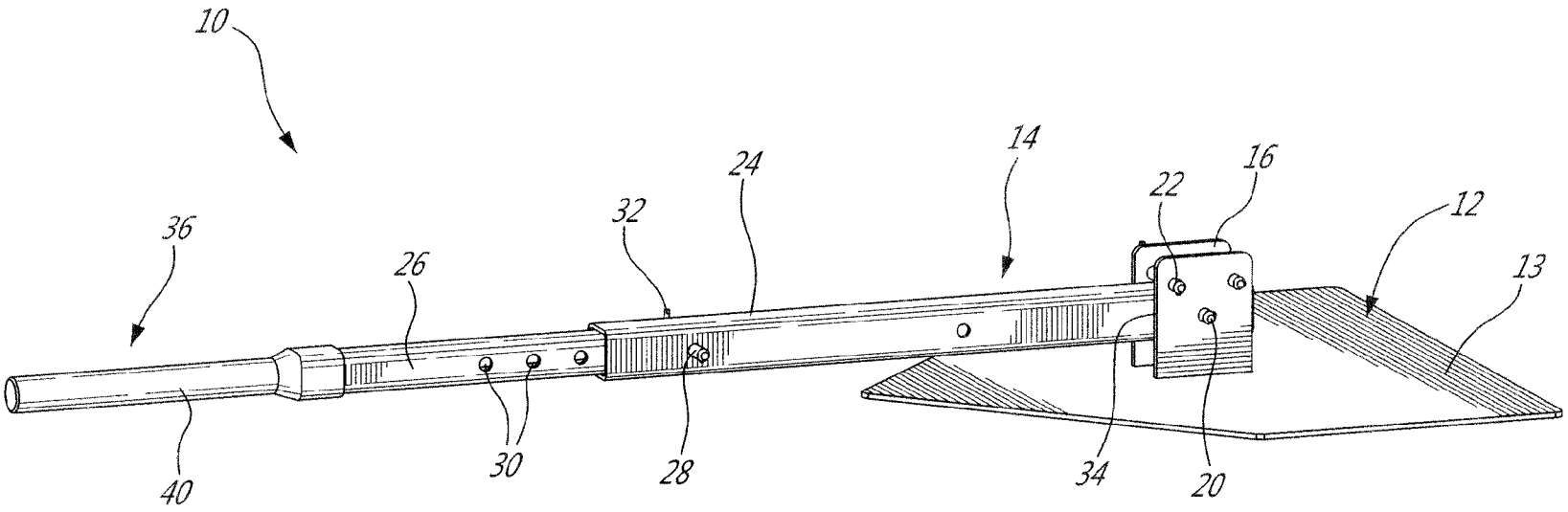
FIG. 4 is a schematic side view of the tee of FIG. 1 in a folded configuration.

Referring to FIG. 4, the batting tee 10 can be folded to a more compact folded configuration, for example suitable for transport, by removing one of the retaining members 22 and pivoting the shaft 14 to a position where it lies against the base plate 13. The retaining member 22 is then put back in place to maintain the shaft 14 in this folded configuration; the height of the retaining members 22 with respect to the base is thus selected such as to allow the folded shaft 14 to extend thereunder while being close enough thereto to limit its movement from the folded configuration. Although not shown in FIG. 4, the shaft 14 can be reduced to its minimum height by engaging the top shaft portion 26 at its lowest position with the bottom shaft portion 24, thus reducing the space required to store and/or transport the tee 10. In this version, the pivot 20 may be removable or permanently connected.

Figure 5:
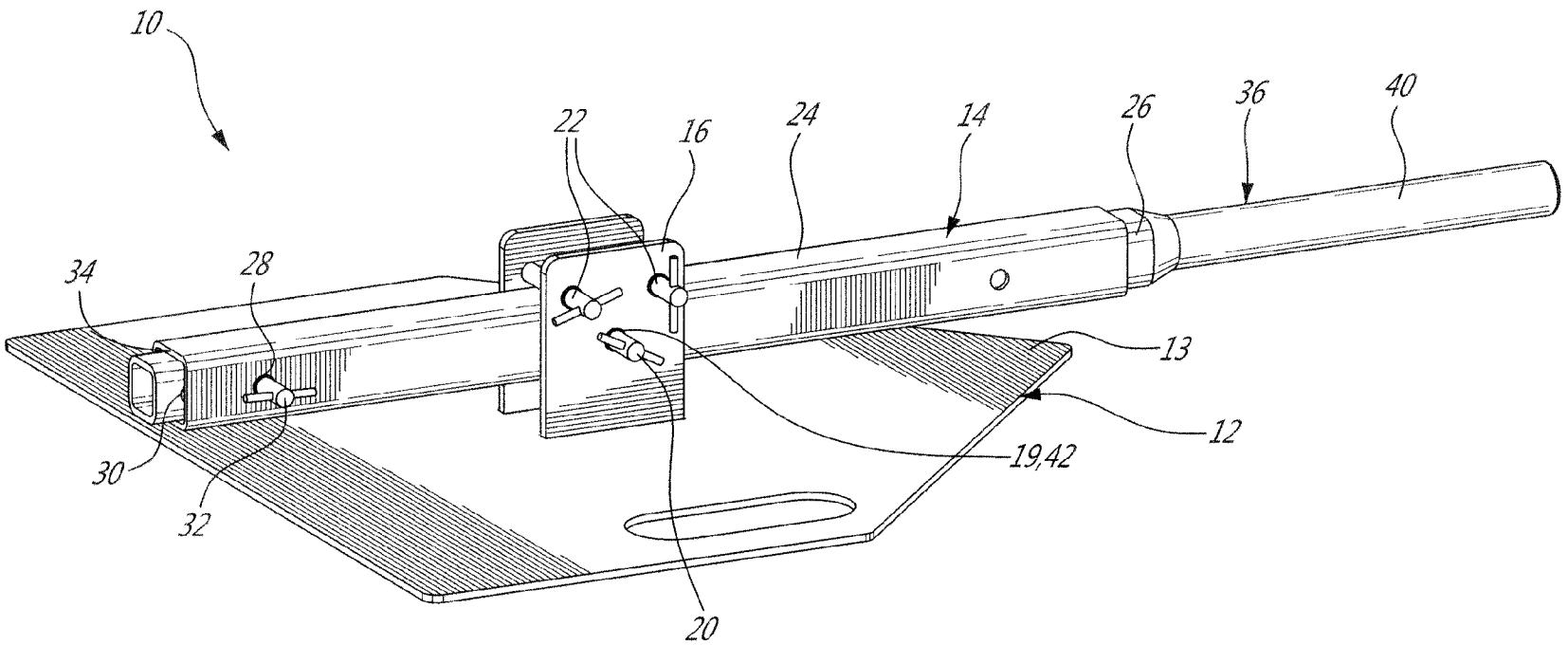
FIG. 5 is a schematic tridimensional view of the tee of FIG. 1 in a storage configuration.
Figure 6:
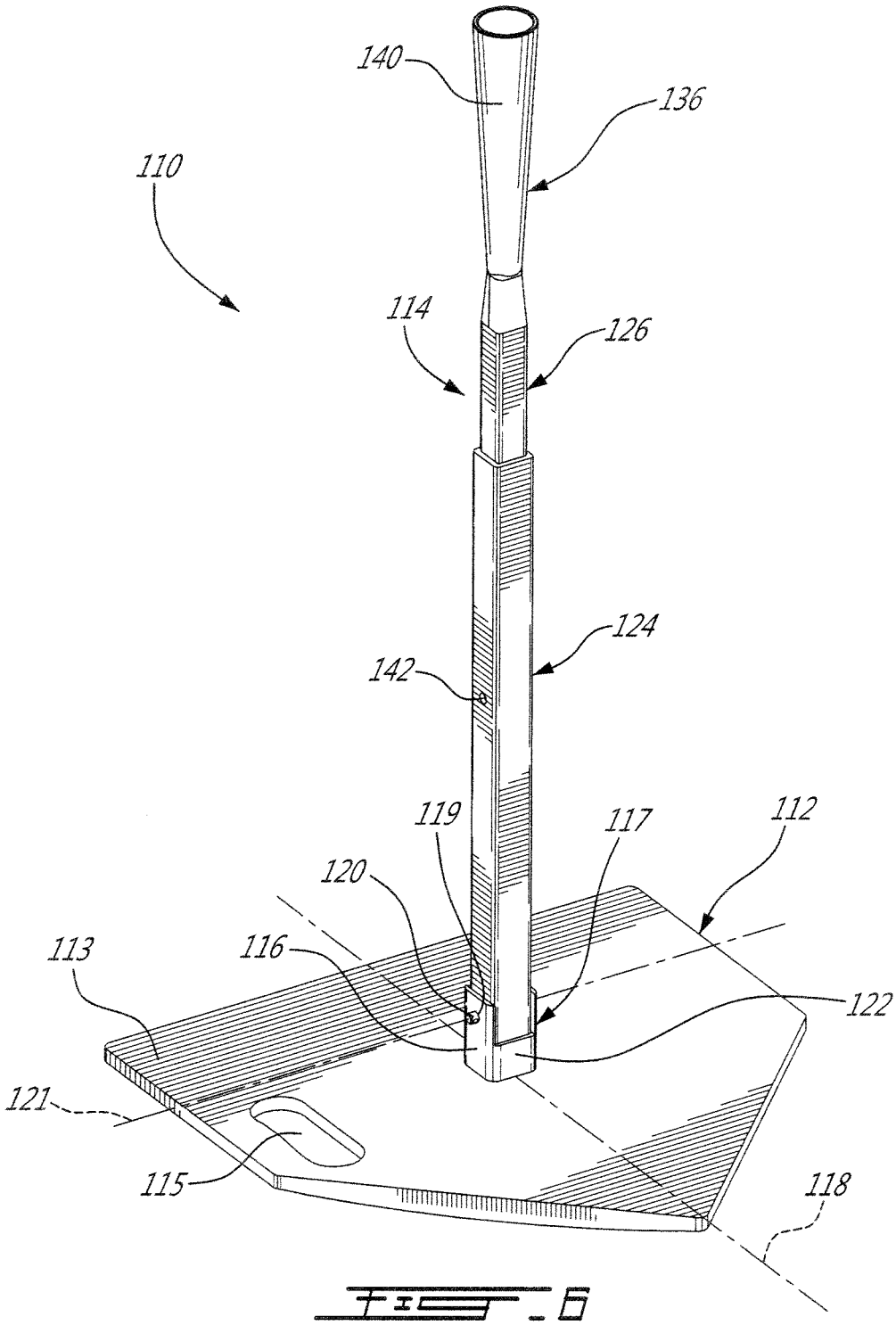
FIG. 6 is a perspective view of a batting tee in accordance with another embodiment.

Referring to FIG. 5, in a particular embodiment the tee 10 has storage configuration which is more compact than the folded configuration described above. The pivot 20 is removable, and each of the bottom and top shaft portions 24, 26 includes a storage hole 42 defined therethrough, at or approximately at mid-height of each shaft portion 24, 26, and sized to receive the pivot 20. It is understood that the storage hole 42 of the shaft portions 24, 26 can correspond to one of the locating holes 28, 30 thereof. When the batting tee 10 needs to be stored and/or transported, the pivot 20 is disengaged from the shaft 14 and from the pivot holes 19 of the support arms 16, so that the shaft 14 is detached from the base 12. The top shaft portion 26 is inserted into the bottom shaft portion 24 with the storage holes 42 being aligned, and the shaft 14 is placed against the base plate 13 and under the retaining members 22, with the storage holes 42 aligned with the pivot holes 19 of the support arms 16, or with another set of aligned holes (not shown) formed in the support arms 16 designed for this purpose. The pivot 20 is inserted through the support arm pivot holes 19 or other holes of the support arms 16 and through the storage holes 42, and locked in place. The batting tee 10 now has a very compact storage configuration, with the shaft 14 minimally extending beyond the base plate 13, and with the retaining members 22 and pivot 20 retaining the shaft 14 against the base plate 13 and preventing or substantially preventing rotation of the shaft 12 about the pivot 20.

Referring to FIGS. 6-9, a tee 110 according to an alternate embodiment is shown. The base 112 includes a base plate 113, which optionally has a handle hole 115 defined therein for carrying the tee in the storage configuration (further detailed below). The base 112 further includes a retaining module 117 defining two spaced apart support arms 116 which extend upwardly from the base plate 113, located on a respective side of and at a same distance from the axis of symmetry 118 of the base plate 113. The support arms 116 include aligned pivot holes 119 receiving a pivot 120 defined by a removable bolt which extends therebetween in proximity of the base 112, and in a central position along the axis of symmetry 118. Although not shown, the pivot 120 may be attached to an element of the base plate 113, for example through a chain, to minimize the risk of loosing the pivot 120 when disengaged from the two support arms 116.

The retaining module 117 also includes two spaced apart and preferably parallel retaining members 122 in the form of plates extending from the base plate 113 between the support arms 116 and each located on a respective side of the pivot 120. The retaining members 122 have a top end which extends lower than the height of the pivot 120 with respect to the base plate 113. For example, in a particular embodiment, the plates of the retaining members 122 extend up to about 1 inch above the base plate 113 while the pivot 120 is located about 1 9/16 inch above the base plate 113; other dimensions are of course possible. In a particular embodiment, the base plate 113 and retaining module 117 are made of a suitable moldable material and are integrally molded.

The shaft 114 is telescopic, and includes a bottom portion 124 which receives a top portion 126 therein. The bottom and top portions 124, 126 include an indexing mechanism for selectively adjusting the height of the top portion 126 within the bottom portion 124.

Figure 7:
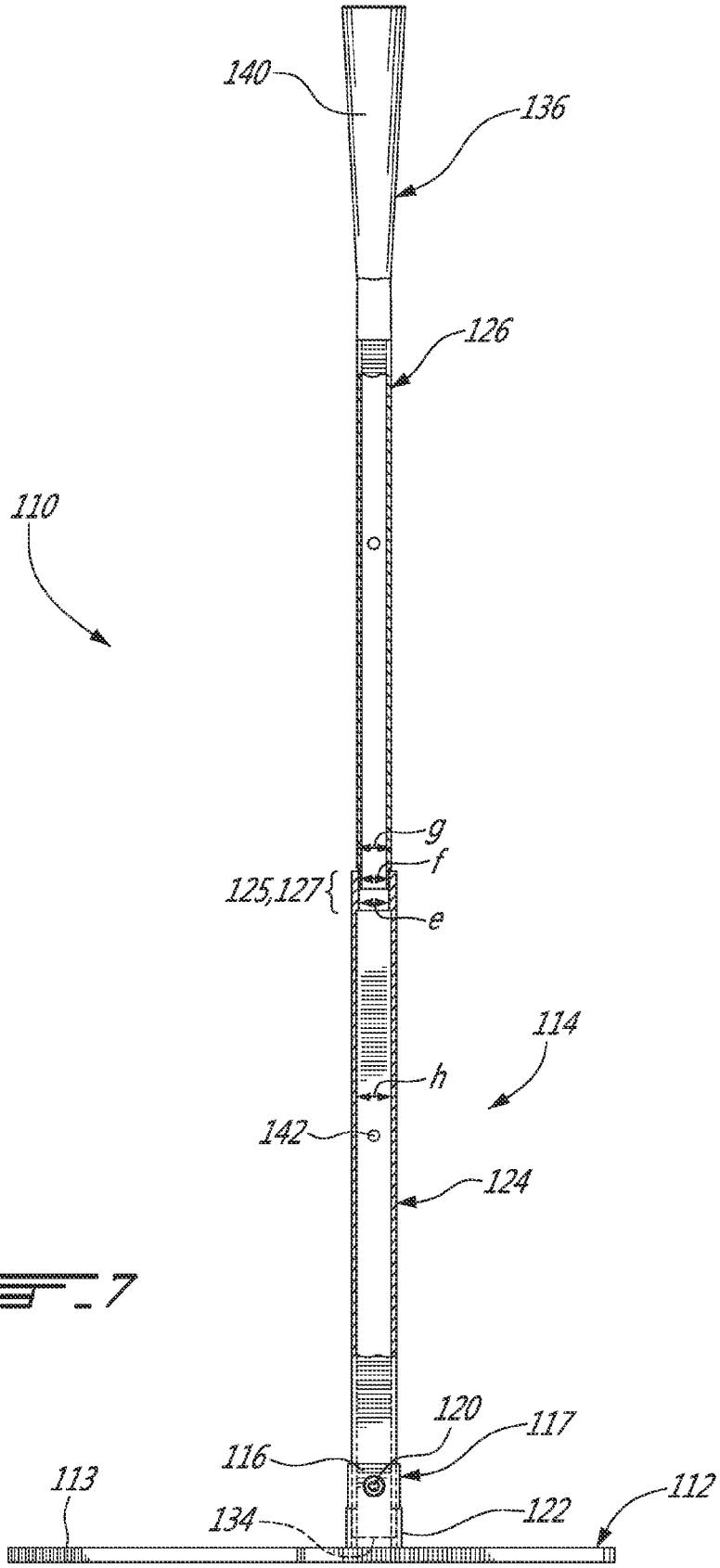
FIG. 7 is a schematic side cross-sectional view of the tee of FIG. 6, with the top shaft portion being partially inserted into the bottom shaft portion.
Figure 8:
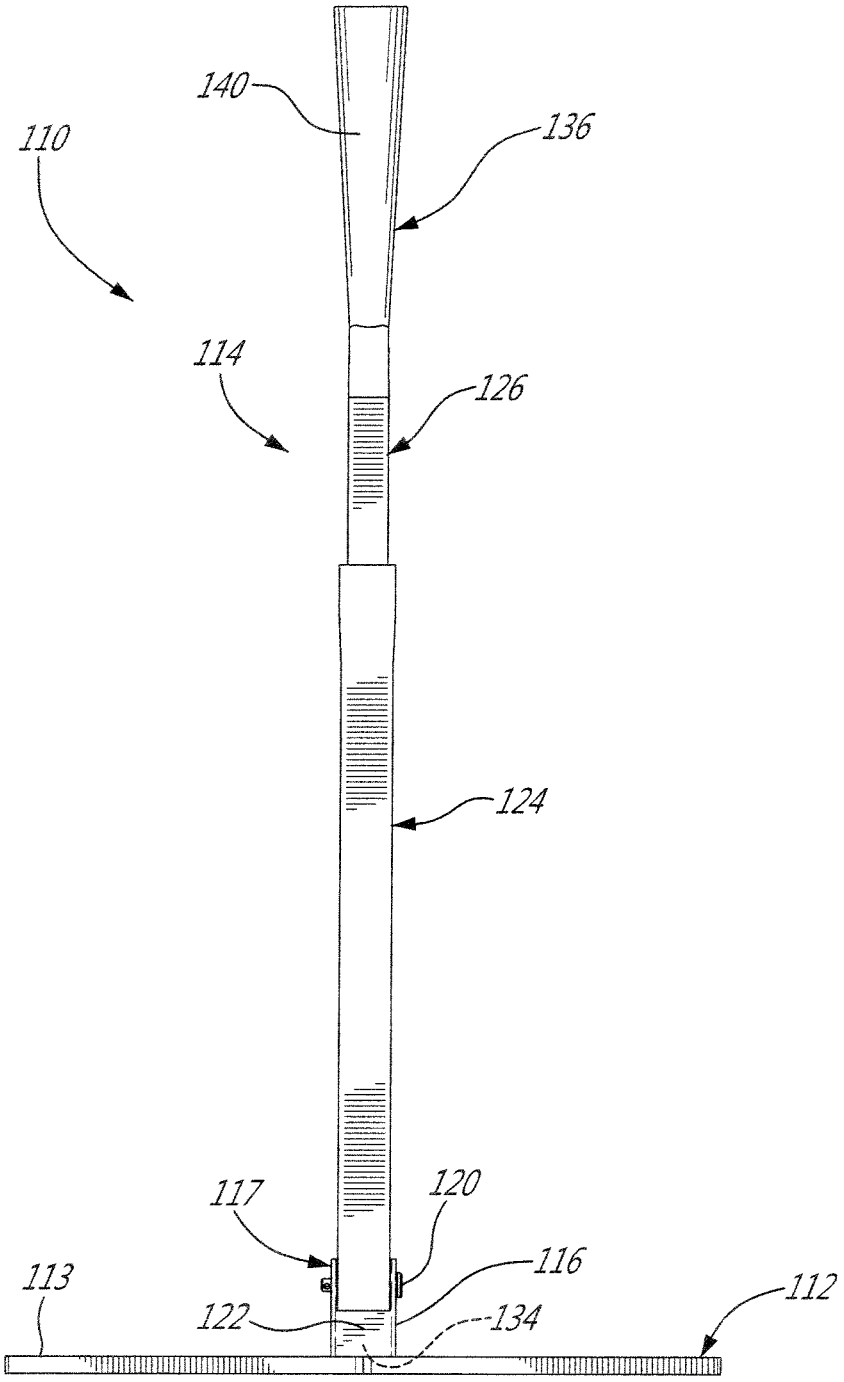
FIG. 8 is a schematic front view of the tee of FIG. 6, with the bottom and top shaft portions engaged.

Referring to FIG. 7, in a particular embodiment, the bottom and top shaft portions 124, 126 are made of suitable type of elastomeric material such as for example polyurethane, and the indexing mechanism is a friction-based retaining mechanism. The bottom shaft portion 124 has a top extremity 125, for example defined along the topmost ½ or 1 inch of the bottom shaft portion 124, which is more flexible than the rest of the bottom shaft portion 124. The top extremity 125 also has slightly reduced cross-sectional internal dimensions e with respect to those of the rest of the bottom portion 124, indicated at h. Correspondingly, the top shaft portion 126 has a bottom extremity 127, for example defined along the bottommost ½ or 1 inch of the top shaft portion 126, which has slightly reduced cross-sectional external dimensions f corresponding to the reduced cross-sectional internal dimensions e of the top extremity 125 of the bottom shaft portion 124, such as to be snuggly received therein; in other words, dimensions e and f are equal or approximately equal. The remainder of the part of the top shaft portion 126 receivable within the bottom shaft portion 124 has external cross-sectional dimensions g which correspond to the internal cross-sectional dimensions h of the rest of the bottom shaft portion 124, such as to be snuggly received therein; in other words, dimensions g and h are equal or approximately equal. The top shaft portion 126, with the exception of the support portion 140 as will be further discussed below, is made of a material harder than that of the top extremity 125 of the bottom shaft portion 124. Therefore, when the top shaft portion 126 is inserted into the bottom shaft portion 124, the corresponding dimensions e, f of the top and bottom extremities 125, 127 allows for an easy initial insertion, and when the bottom extremity 127 is moved downwardly of the top extremity 125, the larger and harder remainder of the top shaft portion 126 received in the smaller top extremity 125 of the bottom shaft portion 124 causes the more flexible top extremity 125 to be slightly deformed and to retain the top shaft portion 126 in place through friction.

In a particular embodiment, both shaft portions 124, 126 are made of polyurethane, with the top extremity 125 having a hardness of 50 A and the remainder of the bottom shaft portion 124 and the top shaft portion 126 (with the exception of the top support portion 140) having a hardness of 80 A. Both shaft portions have a square cross-section, with dimensions e and f being equal or approximately equal to 25/32 inch, and dimensions g and h being equal or approximately equal to ⅞ inch. Of course, alternate materials and dimensions are also possible, as long as they allow the top shaft portion 126 to be retained within the bottom shaft portion 124 through friction while enabling height adjustment.

Alternately, if a material not allowing retention by friction is used, corresponding retaining holes in the shaft portions 124, 126 engaged with a pin as described in the previous embodiment may alternately be used to retain the top shaft portion 126 within the bottom shaft portion 124.

As in the previous embodiment, in the use configuration (shown in FIGS. 6-8) the shaft's bottom end 134 is received between the two support arms 116 and between the two retaining members 122, and the bottom shaft portion 124 is pivotally connected to the base 112 adjacent the bottom end 134, through the pivot 120 extending through the pivot holes 119, such as to be pivotable about a single axis 121. The hole defined through the shaft 114 to receive the pivot 120 is centered, and located such that the bottom end 134 is retained above the base plate 113 while leaving a gap therebetween, for example ¼ inch, to allow for the pivoting motion of the shaft 114.

As in the previous embodiment, the bottom portion 124 of the shaft is dimensioned to have a free space between the bottom portion 124 and support arms 116 in order to allow the shaft 114 to pivot without interference from the support arms 116, and to have a free space between the bottom portion 124 and retaining members 122 in order to allow a limited pivoting motion of the shaft 114 between contact with each of the retaining members 122, while still allowing the shaft 114 to remain in an upright position suitable for supporting the ball throughout the range of possible positions between the two retaining members 122. In a particular embodiment, the retaining members allow a pivoting motion of approximately 5 degrees or less, and preferably 2 degrees or less about the pivot 120.

The shaft's top end 136 is configured to support the ball, and in a particular embodiment where the shaft 114 is made of a suitable type of elastomeric material such as for example polyurethane, the support portion 140 is integrally molded with the remainder of the top portion 126. The support portion 140 is preferably made of a more flexible material than that of the remainder of the top portion 126, and may be made of the same material as that of the of the top extremity 125 of the bottom portion 124 for ease or manufacturing. It is understood here that "more flexible material" also includes a similar material having different properties, for example polyurethane with different durometer values. The configuration of the cylindrical support 140 is similar to that of the cylindrical support 40 described above and shown in FIG. 10, and as such will not be further described herein.

Figure 9:
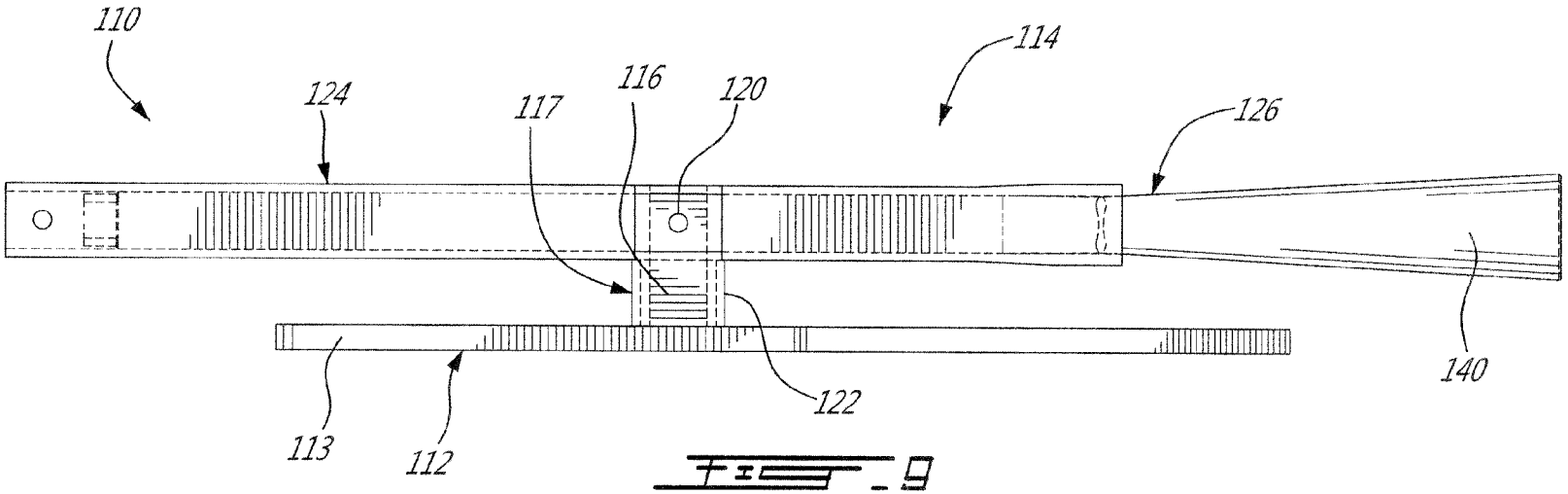
FIG. 9 is a schematic side view of the tee of FIG. 6 in a storage configuration.

Referring to FIG. 9, the storage configuration is shown. Each of the bottom and top shaft portions 124, 126 includes a storage hole 142 defined therethrough, at or approximately at mid-height of each shaft portion 124, 126, and sized to receive the pivot 120. Preferably the storage holes 142 are positioned such that when in alignment, the engaged top and bottom shaft portions 124, 126 define a minimal combined shaft length. The pivot 120 is disengaged from the shaft 114 and support arms 116 and the shaft 114 is detached from the base 112. The top shaft portion 126 is inserted into the bottom shaft portion 124 with the storage holes 142 being aligned, and the shaft 114 is placed against the top of the retaining members 122, with the storage holes 142 aligned with the pivot holes 119 of the support arms 116, or with other aligned holes defined in the supporting arms 116 for this purpose (not shown). The pivot 120 is inserted through the support arm pivot holes 119 (or other support arm holes) and through the storage holes 142, and locked in place. The height of the retaining members 122 is thus selected such as to allow alignment of the pivot hole 119 and storage holes 142 with the shaft resting thereon. The retaining members 122 prevent or substantially prevent rotation of the shaft 112 about the pivot 120 in the storage position.

In both embodiments, in use, when a player hits the top support 40, 140 of the batting tee 10, 110 instead of or while hitting the ball, part of the energy transferred to the tee 10, 110 is absorbed by the elastomeric support 40, 140, and another part of this energy is dissipated by a back and forth rocking motion of the shaft 14, 114 allowed between the two retaining members 22, 122. The energy dissipated by this limited pivoting motion of the shaft 14, 114 about the pivot axis 21, 121 advantageously increases the stability of the tee 10, 110 and improves its ability to remain in the upright position after impact.

In addition, the batting tee 10, 110 in the storage configuration with the pivot 20, 120 through the pivot holes 19, 119 and storage holes 42, 142 has a very compact configuration, with the shaft 14, 114 minimally extending beyond the base plate 13, 113. In a particular embodiment, the shaft 14, 114 protrudes only between 4 and 8 inches beyond the base plate 13, 113, thus offering an adequate configuration for transport and storage. The handle hole 15,115 advantageously allows the tee 10,110 to be carried similarly to a suitcase.

Moreover, depending on the materials used, it may be possible to obtain a relatively low weight of the tee 10, 110; for example, for a tee made of polyurethane, it may be possible to have a total weight of between 5 and 7 pounds. Such a low weight facilitates transport but may also allow the tee to be used as a promotional article, for example for a particular baseball team or player.

The embodiments of the invention described above are intended to be exemplary. Those skilled in the art will therefore appreciate that the foregoing description is illustrative only, and that various alternate configurations and modifications can be devised without departing from the spirit of the present invention. As non-limiting examples, the shaft may be of a single piece, or telescopic in more than two pieces; the shape of the base and/or of the shaft cross-section may be varied; the position of the support arms on the base may be varied, i.e. not centered on the base plate; alternate configurations for the retaining members are also possible. Accordingly, the present invention is intended to embrace all such alternate configurations, modifications and variances which fall within the scope of the appended claims.

I claim:

1. A batting tee comprising:

a base plate;

two spaced apart support arms extending upwardly and directly from the base plate;

first and second spaced apart retaining members extending transversely between the support arms, the retaining members being connected to the support arms;

a pivot extending transversely between the support arms at a location intermediate that of the two retaining members; and a shaft having a top end configured to support a ball, and an opposed bottom end received between the two support arms and between the retaining members, the shaft being connected adjacent the bottom end to the two support arms by the pivot extending therethrough with the bottom end being spaced apart from the base plate and being located below the retaining members, the pivot defining a single pivot axis about which the shaft is pivotable relative to the base plate;

the retaining members allowing a limited pivoting motion of the shaft about the single pivot axis between a first position where contact between the shaft and the first retaining member prevents the pivoting motion in a first direction and a second position different from the first position where contact between the shaft and the second retaining member prevents the pivoting motion in a second direction opposite the first direction the first and second positions of the shaft being spaced apart by at most approximately 5 degrees, with an intermediate position being defined between the first and second positions, the shaft in the intermediate position extending perpendicularly to a plane of the base plates.

2. The batting tee as defined in claim 1, wherein the support arms are centered with respect to an axis of symmetry of the base plate.

3. The batting tee as defined in claim 1, wherein the first and second positions of the shaft are spaced apart by at most approximately 2 degrees.

4. The batting tee as defined in claim 1, wherein the shaft has an outer dimension defined perpendicular to the pivot axis and to a longitudinal axis of the shaft being from 1/64 to 5/64 inch smaller than a distance between the two retaining members.

5. The batting tee as defined in claim 1, wherein the retaining members are cylindrical members extending between the two support arms, the support arms have aligned holes defined therethrough, and at least one of the retaining members is removably engaged in the aligned holes of the support arms, the shaft being pivotable down to a folded configuration where the shaft rests against the base plate with its longitudinal axis at least approximately parallel to the base plate when the removable retaining member is disengaged from the aligned holes, a distance between the aligned holes and the base plate allowing engagement of the removable retaining member in the aligned holes when the shaft is in the folded configuration such that the shaft extends between the plate and the removable retaining member.

6. The batting tee as defined in claim 1, wherein the pivot is removably connected to the two support arms through corresponding pivot holes, and the shaft has at least one intermediate hole defined therethrough intermediate of the bottom and top ends, the intermediate hole being sized to receive the pivot therein, the retaining members extending spaced apart from the base plate, the tee being configurable in a storage configuration where the shaft is received between the support arms, and between the base plate and the retaining members, with the longitudinal axis of the shaft at least approximately parallel to the base plate and the pivot engaged through the pivot holes and the intermediate hole.

7. The batting tee as defined in claim 1, wherein the pivot is removably connected to the two support arms through corresponding pivot holes, and the shaft has at least one intermediate hole defined therethrough intermediate of the bottom and top ends, the intermediate hole being sized to receive the pivot therein, and the retaining members extend from the base plate at a distance less than a distance between the pivot and the base plate, the tee being configurable in a storage configuration where the shaft is received between the support arms over the retaining members with the longitudinal axis of the shaft at least approximately parallel to the base plate and the pivot engaged through the pivot holes and the intermediate hole.

8. The batting tee as defined in claim 1, wherein the shaft includes a bottom portion and a top portion slidable within the bottom portion, and an indexing mechanism for selectively adjusting a height of the top portion within the bottom portion.

9. The batting tee as defined in claim 8, wherein the bottom portion has a major part having internal cross-sectional dimensions corresponding to maximal external cross-sectional dimensions of a part of the top portion being received in the bottom portion, a top extremity of the bottom portion having reduced internal cross sectional dimensions with respect to the major part of the bottom portion and being made of a material more flexible than that of the part of the top portion being received in the bottom portion, the flexible material being deformable through insertion of the top portion therein and retaining the top portion through frictional engagement therewith.

10. The batting tee as defined in claim 9, wherein the bottom portion and top portion are made of polyurethane, the top extremity of the bottom portion having a first durometer value, and the remainder of the bottom portion and the part of the top portion being received in the bottom portion having a second durometer value larger than the first durometer value.

11. The batting tee as defined in claim 10, wherein the top end of the shaft includes a ball support portion made of a polyurethane having a durometer value smaller than the second durometer value.

12. The batting tee as defined in claim 1, wherein the top end of the shaft includes a ball support portion defining a frusto-conical inner surface for receiving the ball, the frusto-conical inner surface extending at an angle of approximately 45° to 75° from the horizontal when the shaft extends vertically.

13. A batting tee comprising:

a base plate;

two spaced apart support arms extending upwardly from the base plate, the support arms having aligned pivot holes defined therethrough;

first and second spaced apart retaining members extending between the support arms, the retaining members being connected to the support arms or to the base plate and being each located on a respective side of the pivot holes;

a pivot removably retainable through the aligned pivot holes; and a shaft having a pivot hole defined therethrough at a bottom end thereof and having a top end shaped to support a ball, the shaft being alternately configurable in a use configuration and in a storage configuration;

wherein in the use configuration, the bottom end of the shaft is received between the support arms and between the retaining members, the shaft being pivotally connected to the support arms adjacent the bottom end by the pivot extending through the pivot hole of the shaft and through the pivot holes of the support arms with the bottom end spaced apart from the base plate, the pivot defining a single pivot axis about which the shaft is pivotable relative to the base plate in a pivoting motion along a path limited between a first position where contact between the shaft and the first retaining member prevents the pivoting motion in a first direction and a second position different from the first position where contact between the shaft and the second retaining member prevents the pivoting motion in a second direction opposite the first direction, the shaft through the limited path remaining sufficiently close to a vertical position to retain the ball on the top end; and wherein in the storage configuration, the shaft is positioned between the support arms with a longitudinal axis of the shaft at least approximately parallel to the base plate, the shaft being retained to the base plate by the removable pivot extending through a storage hole defined through the shaft and connected to the support arms, the storage hole and pivot hole of the shaft being spaced apart from one another, the retaining members preventing or substantially preventing rotation of the shaft about the pivot.

14. The batting tee as defined in claim 13, wherein the shaft includes a bottom shaft portion, a top shaft portion slidably received within the bottom shaft portion and having the top end shaped to support the ball, and an indexing mechanism for selectively adjusting a height of the top shaft portion within the bottom shaft portion, and wherein in the storage configuration, the removable pivot extends through aligned storage holes defined through the bottom and top shaft portions and connected to the support plates.

15. The batting tee as defined in claim 13, wherein the retaining members are cylindrical members extending between the storage plates spaced apart from the base plate, and in the storage configuration, the shaft extends between the base plate and the cylindrical members to prevent or substantially prevent the rotation of the shaft about the pivot.

16. The batting tee as defined in claim 13, wherein the retaining members are plates extending upwardly from the base plate between the support plates, and in the storage configuration, the shaft rests against the plates of the retaining members to prevent or substantially prevent the rotation of the shaft about the pivot.

17. The batting tee as defined in claim 14, wherein the indexing mechanism includes a top extremity of the bottom shaft portion being dimensioned to frictionally engage a corresponding section of a major part of the top shaft portion being inserted therein, the top extremity being made of a material more flexible than that of a remainder of the bottom shaft portion and that of the major part of the top shaft portion, the flexible material being deformable through insertion of the top shaft portion therein to frictionally retain the top shaft portion at a desired height.

18. The batting tee as defined in claim 17, wherein the top end of the top shaft portion includes a support for retaining the ball, the support being made of material more flexible than that of the major part of the top shaft portion.

19. The batting tee as defined in claim 17, wherein the bottom and top shaft portions are made of polyurethane.

20. The batting tee as defined in claim 13, wherein the top end of the top shaft portion includes a support for retaining the ball, the support defining a frusto-conical inner surface for receiving the ball, the frusto-conical inner surface extending at an angle of approximately 45° to 75° from the horizontal when the shaft extends vertically.

21. The batting tee as defined in claim 13, wherein the first and second positions of the shaft are spaced apart by at most approximately 2 degrees.

* * * * *